United States Patent [19]

Cardin et al.

[11] Patent Number: 4,979,378

[45] Date of Patent: Dec. 25, 1990

[54] COSTUME JEWELRY METHOD OF MAKING COSTUME JEWELRY FROM COTTON BURRS

[76] Inventors: Cathy M. Cardin; C. Dwayne Cardin, both of Rte. 2, P.O. Box 130, Pavo, Ga. 31778

[21] Appl. No.: 464,295

[22] Filed: Jan. 12, 1990

[51] Int. Cl.[5] ..... A44C 25/00

[52] U.S. Cl. ..... 63/2; 29/160.6; 29/458; 427/4; 427/323; 427/407.1; 63/12; 428/17

[58] Field of Search ..... 29/160.6, 458; 427/4, 427/290, 323, 407.1; 63/2, 23, 12, 13; 428/17

[56] References Cited

U.S. PATENT DOCUMENTS 2,906,636 9/1959 Hoivik ..... 427/4

2,968,885 1/1961 Hebb ..... 428/17

2,978,348 4/1961 Fessenden ..... 427/4

3,997,686 12/1976 McClure ..... 427/4

*Primary Examiner*—P. W. Echols

*Attorney, Agent, or Firm*—Jones, Askew & Lunsford

[57] ABSTRACT

A method of making costume jewelry from cotton burrs, heretofore considered trash, is disclosed. The burrs are first cleaned by removing any residual fibers from between the locks of the burr. Next, the stem is cut close to the crown and the crown is ground to provide a substantially planer surface. Next, the burr is painted, and may also have a coat of lacquer applied. Decorative pellets, ribbon segments and other decorative devices are also secured to and between the locks of the burr. Finally, a wearer attachment device is secured to the planar surface created by the grinding step.

22 Claims, 2 Drawing Sheets

COSTUME JEWELRY METHOD OF MAKING COSTUME JEWELRY FROM COTTON BURRS

TECHNICAL FIELD

The present invention relates to manufacture of costume jewelry, and in particular discloses a novel method of making attractive costume jewelry from a pulpy organic material, namely a cotton burr, which has heretofore been considered trash.

BACKGROUND OF THE INVENTION

For over 200 years cotton has been a major cash crop in the southern United States. While cotton is not nearly as ubiquitous in the southeastern United States as it was in the days of the great cotton plantations with a slave-based agricultural economy, it is still a major cash crop. Cotton became a major cash crop in the late part of the 18th century after the invention of the cotton gin which allowed mechanization of the processing of ginning cotton to separate the seeds from the cotton fibers. However, to date cotton has resisted mechanization of the process of picking the bolls. For the same 200 years, the cotton burr, normally left on the stalk and branches of the plant, has been considered trash.

As is well known to those familiar with cotton, the bloom of the cotton plant consists of the cotton burr which are the petals of the flower and the fibrous cotton boll containing the strands of cotton and seeds which grows within the burr. As the plant matures in the field, the burr opens and the petals spread leaving the mature cotton boll ready for picking.

The extent to which the burr opens, and the extent to which the fibers of the cotton boll develop depend on the weather conditions of the growing season, mostly average daytime temperatures and the amount of water the plant receives during the process of maturation of the bloom.

The petals of the cottom burr are called locks, and naturally occur with either four or five locks to the burr. The burr is attached by a short stem to the stalk or a branch of the cotton plant.

Heretofore, cottom burrs were, with very few exceptions, considered trash. It is well known to cotton farmers that it is important to plow under the remaining cotton plants, including stalk, stems and burrs, shortly after harvesting of the cotton fibers. This is because leaving the pulpy plant standing in the field after harvesting is known to exacerbate the population of boll weevils in the next subsequent growing season.

Mature cotton burrs are made of a dry wood-like fibrous material and contain an oil which is similar to cottonseed oil which prevents the burrs from being excessively brittle.

In a word, raw cotton burrs are generally considered ugly. The inventors of the present invention have only encountered two preexisting decorative uses of cotton burrs. First, one of the inventors of the present invention has observed raw cotton burrs attached to a holiday wreath, along with other materials to provide a somewhat "rustic" looking holiday wreath. A pluarlity of burrs were glued directly to a preexisting wreath, together with other materials such as acorns.

Secondly, one of the inventors has observed a figurine representing a Christmas angel constructed from a pair of raw cotton burrs which still included the boll of cotton fiber within the burr. Both of these were somewhat underdeveloped cotton blooms in that the burrs had not opened completely and still formed a cup-like structure in which the boll resided.

SUMMARY OF THE PRESENT INVENTION

The present invention resides substantially in the non-obvious insight that there are aesthetically pleasing aspects of the geometry of cotton burrs which, if properly finished, can be used to make attractive costume jewelry. Therefore, an important aspect of the present invention is the insight that this inedible oil laced, essentially ugly, fibrous portion of a cotton plant could be transformed into an attractive piece of wearing apparel if sufficient care were taken in the construction of such a piece of apparel and appropriate materials were discovered to preserve important characteristics of the burr.

Generally stated, the method of the present invention is the creation of a piece of costume jewelry from a cotton burr. In the most preferred form, of the present method it is important to clean any remaining cotton fibers from between adjacent locks, as there is normally at least a small amount of fiber left between the locks in the picking picking process. Next, the stem of the burr is cut near the crown thereof. Next, the cut is ground to provide a substantially planar surface to which a wearer attachment device will be attached. It is important in the cutting and grinding process that the stem be cut sufficiently close to the crown to provide an acceptable amount of surface area to which the wearer attachment device may be attached. At the same time, it is important that the stem not be cut too closely as grinding the crown too far will cause the locks of the burr to become separated and the burr will fall apart.

Next, a coat of appropriately selected paint is applied which is an important step in a transformation. Criteria for selection of the paint is described in detail hereinbelow.

According to the most preferred form of the present invention a lacquer covering is next applied to the painted surface. The last step is the securing, preferably by gluing, of a wearer attachment device to the substantially planer surface previously created.

According to various alternatives in the method of the present invention, additional materials in the form of either some form of decorative pellet, or pieces of cloth or ribbon are secured to the burr as a final enhancement. Products made according to the method of the present invention also fall within the scope of the invention.

The first embodiments of the product of the present invention made by the inventors were earrings. However, hair barrettes and pendants have since been constructed and other forms of costume jewelry which may be constructed according to the method of the present invention will suggest themselves in light of the disclosure of this specification.

The present invention was first reduced to practice several months before the preparation and filing of this specification. Reaction of individuals who have seen the products made according to the process of the present invention have been overwhelming. The present invention provides a surprising result of a wide variety of appearances of attractive costume jewelry all made from initial raw materials which has a reputation as being either ignored or ugly from denizens of parts of the country where cotton is grown. The present inventors are, as of the filing of this application, looking for ways to improve the fundamental method of the present invention in order to accelerate the process of making these products to meet the demand therefore.

DETAILED DESCRIPTION

Figure 1A:
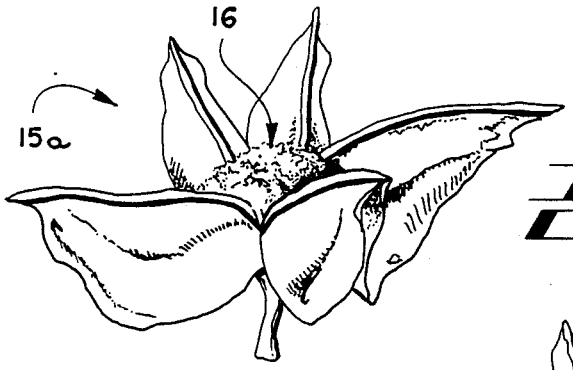
FIG. 1A shows a raw five lock burr.
Figure 1B:
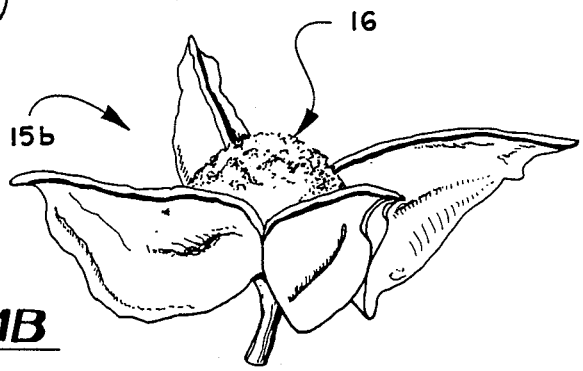
FIG. 1B shows a raw four lock cotton burr.

Turning next to the drawing figures in which like numerals represent like parts, the method of the preferred embodiment of the present invention will now be described. FIGS. 1A and 1B shows exemplary raw cotton burrs as picked from a cotton plant, which burrs constitute the starting materials for the method of the present invention. FIG. 1A is a five lock burr and FIG. 1B is a four lock burr. In each of FIGS. 1A and 1B, small amounts of cotton fiber, shown at 16, are typically left between the locks after the boll has been picked. The first step in the preferred embodiment of the present invention is to carefully remove the remaining cotton fibers so as to provide a clean surface to which paint will adhere. At the present time, this step is preferably performed by hand using a small set of tweezers to remove residual cotton fibers. The inventors believe that any chemical process which could dependably loosen the residual fiber without otherwise damaging the burr would be a preferable approach in order to speed the manufacturing process, although to date none has been identified.

Figure 2:
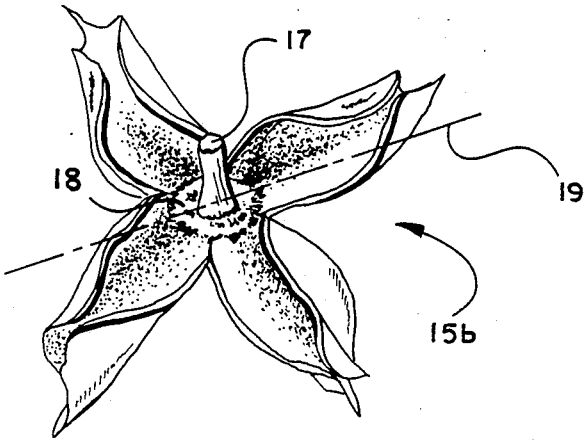
FIG. 2 shows the underside of the typical four lock burr and indicates where stem cutting is to take place according to the method of the present invention.

FIG. 2 shows the back side of a typical four lock burr and indicates where it is appropriate to make a cut in the stem 17 of the burr. The backs of cotton burrs include a fibrous mound of material called the crown, indicated at 18 in FIG. 2. It is important in the stem cutting step of the preferred embodiment of the present invention to cut the stem near the crown, but not to cut too deeply into the crown. A cut at the position indicated by dashed line 19 (FIG. 2) is appropriate for most burrs. If the cut is made too far from the crown on the stem, too much of the stem will remain to accommodate the next subsequent step of grinding the cut stem and crown. If the cut is made too deeply into the crown, the burr will disintegrate since the crown holds the locks together. Too deep a cut will cause the crown to fall apart and the locks to separate, thus destroying the burr.

As of the date of preparation of this specification, the preferred method of cutting is simply to use conventional diagonal cut pliers such as are often used for cutting small gauge wire.

The next step of the method is to grind the crown at the cut made in the previous step to form a substantially planar surface 20 on the crown. While the amount of grinding possible will vary from burr to burr, it is desired to have as large a planar surface as possible without cutting too deeply into the crown material which will, as pointed out above, cause the burr to fall apart. The preferred method of grinding is to grind the crown with a small electric rotary grinder having a fine grit of emery paper connected around the periphery of a short cylindrical grinding surface. Naturally, sandpaper, fine grit grinding stones, and other devices may also be used to accomplish this step of the method.

The next step of the preferred embodiment of the method of the present invention is application of a paint to the burr. To date, two specific types of paint have been found to be appropriate for painting burrs. First, acrylic paint is appropriate for spraying or hand painting, hand painting being preferable. Oil based latex paint has been found to be appropriate for dipping the burrs in a step in which the partially completed piece is dipped into a bath of oil based latex paint. Both acrylic and oil based latex have been found to adequately adhere to the material of the cotton burr, although experience to date indicates that acrylic paint is inappropriate for dripping. Paints which will not adhere to a pulpy surface having an oil of the type present in cotton burrs should be avoided in this step.

The next step in the preferred embodiment of the method of the present invention is the securing of a wearer attachment device of the planar surface formed on the crown. It should be understood that the original conception and reduction to practice of the method of the present invention was to make a set of earrings from cotton burrs. In this case, the wearer attachment device included a typical stud mounted at right angles to a circular planar surface, which stud was sized appropriately for passing through the hole of a pierced ear lobe for attachment to the ears of the wearer. Additionally, ear clasps for clip-on earrings for people who lack pierced ears have been used.

Figure 4:
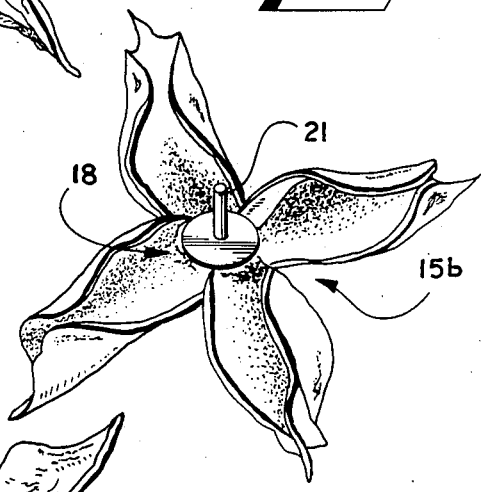
FIG. 4 shows a wearer attachment device secured to the planar area of the crown after grinding.

Since the first reduction to practice, hair barrettes and pendants have also been constructed according to the method of the present invention. In the case of barrettes, it is believed preferable to insert a thin sliver of wood (not shown) between a mounting surface present on the barrette clasp and the planar surface 20 of the crown. This provides a more secure attachment for the burr to the barrette and prevents damage to the burr and separation of same from the wearer apparel device when the barrette is used. It is believed that a similar mounting method should be used for pendants. The glue described hereinbelow is appropriate for securing both planar surface 20 and the wearer attachment device to the wood when this option is used. This will be understood that the term wearer attachment device as used in this specification encompasses any typically used piece of apparatus for securing the decorative portion of a piece of jewelry to either the person or the clothing of the user. In FIG. 4, the exemplary preferred embodiment of the wearer attachment device is ear stud 21.

Since cotton burrs contain amounts of residual oil, it is important to select an adhesive which will bind both a non-porous surface such as a metal wearer attachment device and bind dependably to the ground planar surface of the cotton burr without suffering from adverse effects of the burr's oil. Similarly, since the preferred embodiment of the method of the present invention is one in which the wearer attachment device is attached to the planar surface after painting, it is important that the adhesive be one which will bond effectively to the painted surface of the burr. The inventors of the present invention have found that an adhesive sealant marketed as type E6000 by Eclectic Products, Inc. of Carson, Calif. is, as the date of preparation of this specification, believed to be the most appropriate adhesive material for the step of securing wearer attachment device to the ground crown surface. The type E6000 glue is described as an adhesive sealant for high performance industrial requirements and is made of toluene VM and naphtha.

It is believed that other adhesives will also be found to be adequate to the job. Therefore, the disclosure of the E6000 type adhesive is made in compliance with the best mode requirement of the patent law and is not intended to be limiting of the scope of the present invention.

Figure 5:
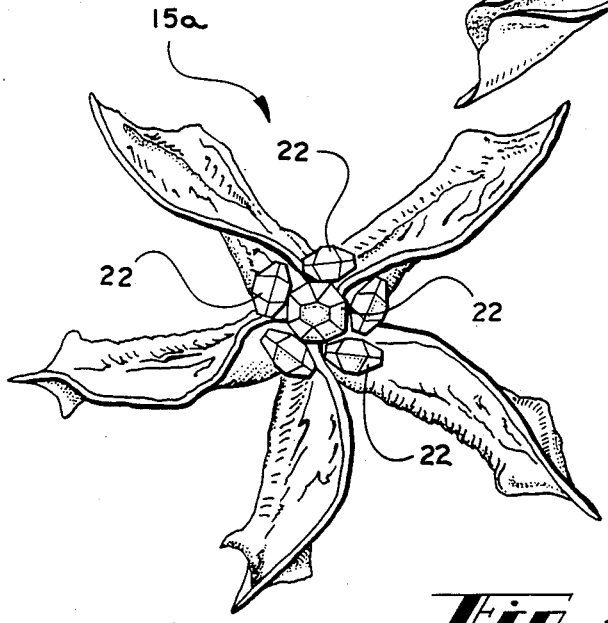
FIG. 5 shows a five lock burr with an exemplary set of decorative pellets secured thereto.

The steps described heretofore are adequate to form an essentially complete piece of surprisingly attractive costume jewelry. According to the most preferred form of the present invention, additional decorative materials are applied to the painted burr. The inventors of the present invention have created a wide variety of product embodiments of the present invention by applying different decorative elements to the painted burrs. In particular, rhinestones, glass and plastic beads have been applied. A virtually limitless variety of items can be attached in any manner which pleases the manufacturer. An exemplary embodiment of an earring constructed according to the method of the present invention is shown in FIG. 5 in which red plastic beads 22 were glued to a burr which was painted green to be suggestive of holly leaves and berries for the December holiday season. In this specification the term decorative pellet has been adopted to encompass any pelletized or granular materials which are applied to the surface of the burr either before or after, but preferably after painting. Of course, gem stones could be attached but the possibility of losing same make such a step less desirable.

The inventors of the present invention have discovered that the above cited toluene VM and naphtha glue is appropriate for securing non-porous decorative pellets to the painted surface of the burr in a dependable fashion.

Figure 6:
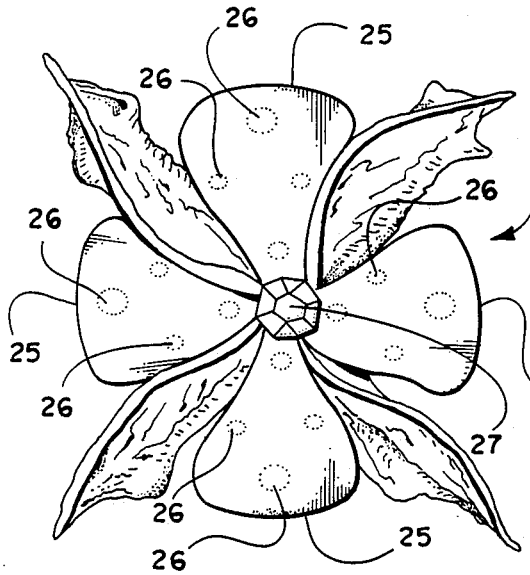
FIG. 6 shows an alternate construction using a four lock burr and pieces of ribbon attached between adjacent locks.
Figure 3:
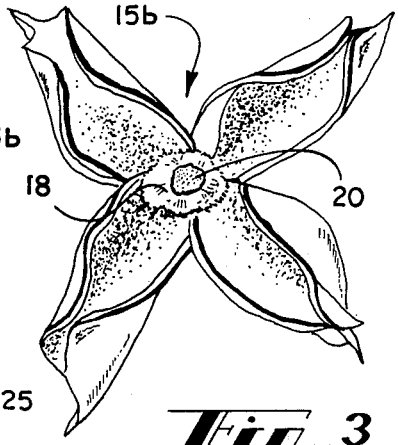
FIG. 3 shows the stem and burr crown after the grinding step of the preferred embodiment.

A second alternative for decorative materials is shown in FIG. 6. FIG. 6 shows an earring made from a four lock burr having a plurality of pieces of ribbon 25 glued between adjacent pairs of locks. The ribbon segments in this case included crimped foil reflective material shown, for example, at 26 in FIG. 6. A rhinestone 27 was secured to the center of these particular earrings.

Again, the above referenced glue has been found adequate to secure the porous ribbon material to the painted surface of the burr.

As noted hereinabove, an important aspect of the present invention constitutes the non-obvious insight that a piece of agricultural trash, which has been standing in the field for several hundred years throughout a significant portion of the Unites States could be transformed into attractive pieces of costume jewelry. Products made according to the process of the present invention described hereinabove also fall within the scope of the present invention.

The foregoing has been a description of the preferred embodiment of the method of the present invention and the products resulting therefrom. Furthermore, the foregoing description sets forth the best mode of practicing the invention contemplated by the inventors as of the date of execution of the present specification. While the present specification sets forth the best mode, the inventors believe that the method of the present invention may be effectively practiced with minor variations. In particular, the order of execution of certain of the steps is not critical. For example, it is possible to secure the wearer attachment device to the ground planar surface prior to painting. This is less desirable from a manufacturing point of view since it requires that care be taken not to apply paint to the wearer attachment device. So long as materials are properly selected so that adhesives used will not be adversely impacted by the burr's oil content or any previously applied paint or lacquer, variations in the order of execution of the steps are possible.

In view of the foregoing disclosure of the preferred embodiment of the method of the present invention, and the products resulting therefrom, other embodiments and specific details will suggest themselves to those skilled in the art of manufacture of costume jewelry. Therefore the scope of the present invention is to be limited only by the claims below.

We claim:

1. A method of making costume jewelry from a cotton burr having a stem and a plurality of locks comprising the steps of:

cutting said stem at the crown thereof;

grinding said crown to provide a substantially planar surface thereon;

applying a paint covering to said burr;

applying a coating of lacquer over said paint covering; and attaching a wearer attachment device to said substantially planar surface.

2. The method of claim 1 further comprising the step of:

attaching at least one decorative pellet to a nexus of said plurality of locks on a side of said burr opposite said wearer attachment device.

3. The method of claim 2 wherein said step of attaching at least one decorative pellet to said nexus comprises a step of applying an adhesive sealant to said decorative pellet.

4. The method of claim 3 wherein said adhesive sealant is a mixture of toluene VM and naphtha.

5. The method of claim 14 further comprising the step of:

attaching a plurality of ribbon segments between adjacent ones of said plurality of locks.

6. The method of claim 1 wherein said step of attaching a wearer attachment device to said substantially planar surface comprises a step of applying an adhesive sealant to both said wearer attachment device and said substantially planar surface.

7. The method of claim 6 wherein said adhesive sealant is a mixture of toluene VM and naphtha.

8. The method of claim 1 wherein said step of applying a paint covering to said burr comprises a step of applying a coat of acrylic paint to said burr.

9. The method of claim 8 wherein said step of applying a paint covering to said burr comprises a step of spraying said coat of acrylic paint onto said burr.

10. The method of claim 1 wherein said step of applying a paint covering to said burr comprises a step of applying a coat of oil-based latex paint to said burr.

11. The method of claim 10 wherein said step of applying a paint covering to said burr comprises a step of dipping said burr into oil-based latex paint.

12. The method of claim 1 wherein said step of grinding said crown comprises a step of grinding said crown with an outer cylindrical surface of a rotary grinding tool.

13. The method of claim 1 further comprising the step of: cleaning cotton fibers from between adjacent ones of said plurality of locks.

14. The method of claim 1 said step of attaching said wearer attachment device to said substantially planar surface is preceded by a step of removing any excess pulp material from the back of said burr immediately adjacent to said crown.

15. A product made in accordance with the method of claim 1.

16. A method of making costume jewelry from a cotton burr having a stem and a plurality of locks comprising the steps of:

cleaning cotton fibers from between adjacent ones of said plurality of locks;

cutting said stem at the crown thereof;

removing any excess pulp material from the back to said burr immediately adjacent to said crown;

grinding said crown to provide a substantially planar surface thereon;

applying a paint covering to said burr;

applying a coating of lacquer over said paint covering; and attaching a wearer attachment device to said substantially planar surface.

17. The metod of claim 16 wherein said step of attaching a wearer attachment device to said substantially planar surface comprises a step of applying an adhesive sealant to both said wearer attachment device and said substantially planar surface.

18. The method of claim 17 wherein said adhesive sealant is a mixture of toluene VM and naphtha.

19. A product made in accordance with the method of claim 17.

20. A product made in accordance with the method of claim 16.

21. A method of making costume jewelry from a cotton burr having a stem and a plurality of locks comprising the steps of:

cleaning cotton fibers from between adjacent ones of said plurality of locks;

cutting said stem at the crown thereof;

removing any excess pulp material from the back of said burr immediately adjacent to said crown;

grinding said crown to provide a substantially planar surface thereon;

applying a paint to said burr to provide a paint covering;

applying a coating of lacquer over said paint covering; and attaching a wearer attachment device to said substantially planar surface.

22. A product made in accordance with the method of claim 21.

* * * * *